US005231372A

United States Patent [19]

Caddock, Jr.

[11] Patent Number: 5,231,372

[45] Date of Patent: Jul. 27, 1993

[54] METHOD OF MANUFACTURING HIGH-VOLTAGE AND/OR HIGH-POWER THICK-FILM SCREEN-PRINTED CYLINDRICAL RESISTORS HAVING SMALL SIZES, LOW VOLTAGE COEFFICIENTS, AND LOW INDUCTANCE, AND RESISTOR THUS MANUFACTURED

[75] Inventor: Richard E. Caddock, Jr., Winchester, Oreg.

[73] Assignee: Caddock Electronics, Inc., Riverside, Calif.

[21] Appl. No.: 774,706

[22] Filed: Oct. 9, 1991

[51] Int. Cl.[5] ..... H01C 3/10

[52] U.S. Cl. ..... 338/294; 338/61; 338/322; 338/306; 29/620; 29/621

[58] Field of Search ..... 338/294, 322, 61, 62, 338/306; 29/620, 621

[56] References Cited

U.S. PATENT DOCUMENTS

| | | | |
|---|---|---|---|
| 2,360,263 | 10/1944 | Osterheld | 338/294 |
| 2,838,639 | 6/1958 | Planer et al. | 338/294 |
| 3,858,147 | 12/1974 | Caddock | 338/62 |
| 3,880,609 | 4/1975 | Caddock | 29/620 |
| 3,881,162 | 4/1975 | Caddock | 338/61 |
| 4,072,921 | 2/1978 | Sacchetti | 338/61 |
| 4,132,971 | 1/1979 | Caddock, Jr. | 338/61 |
| 4,159,459 | 6/1979 | Sease et al. | 338/61 |
| 4,670,734 | 6/1987 | Caddock | 338/61 |
| 4,697,335 | 10/1987 | Peterson et al. | 29/620 |
| 4,766,410 | 8/1988 | Caddock, Jr. | 338/275 |
| 4,866,411 | 9/1989 | Caddock | 338/62 |

FOREIGN PATENT DOCUMENTS

| | | |
|---|---|---|
| 0334473 | 2/1989 | European Pat. Off. . |
| 1314388 | 4/1973 | United Kingdom . |

*Primary Examiner*—Marvin M. Lateef
*Attorney, Agent, or Firm*—Richard L. Gausewitz

[57] ABSTRACT

A method of making a compact high-voltage, high-power, thick-film screen-printed cylindrical resistor. A V-serpentine pattern is formed and adapted to fit on a cylindrical substrate having a diameter range of about 1/10 inch to about ½ inch. Such pattern is caused to have adjacent sections at a small acute angle to each other. Furthermore, the pattern is caused to have gaps at the open ends of the loops that are substantially wider than the gaps at the closed ends of the loops. In addition, the pattern is caused to have a sufficient number of undulations, and sufficient gap size, to achieve a predetermined voltage rating. Thereafter, the height of the pattern is changed to achieve a voltage coefficient substantially corresponding to the desired voltage coefficient. Furthermore, the resistive film material is altered to cause it to have a different resistivity, said latter resistivity being such that the same resistance value is achieved. The invention further comprises a cylindrical screen-printed thick-film resistor, and a method of balancing inductance against voltage/power rating.

21 Claims, 2 Drawing Sheets

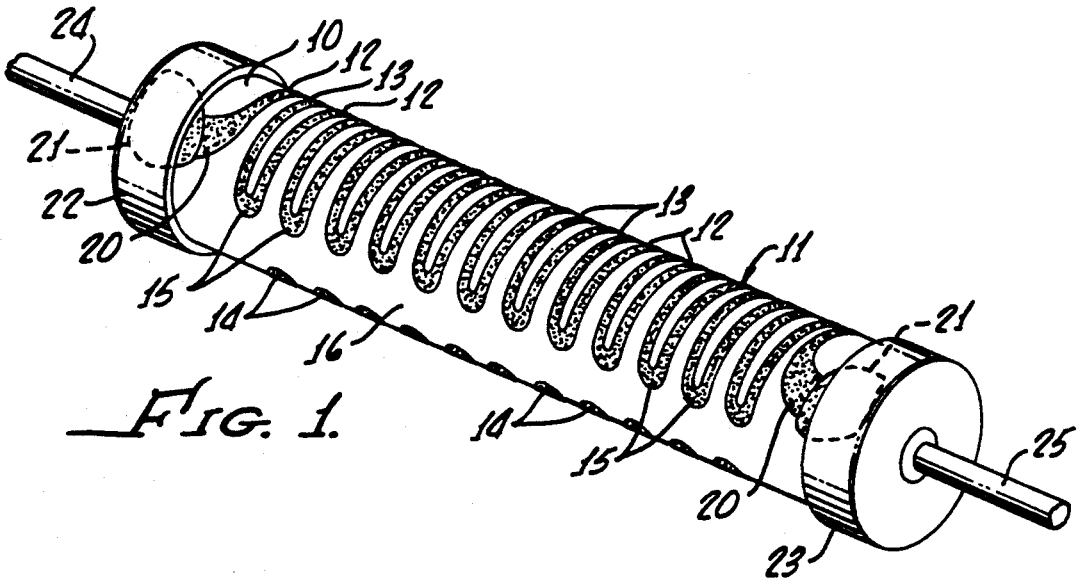
FIG. 1.
FIG. 3.
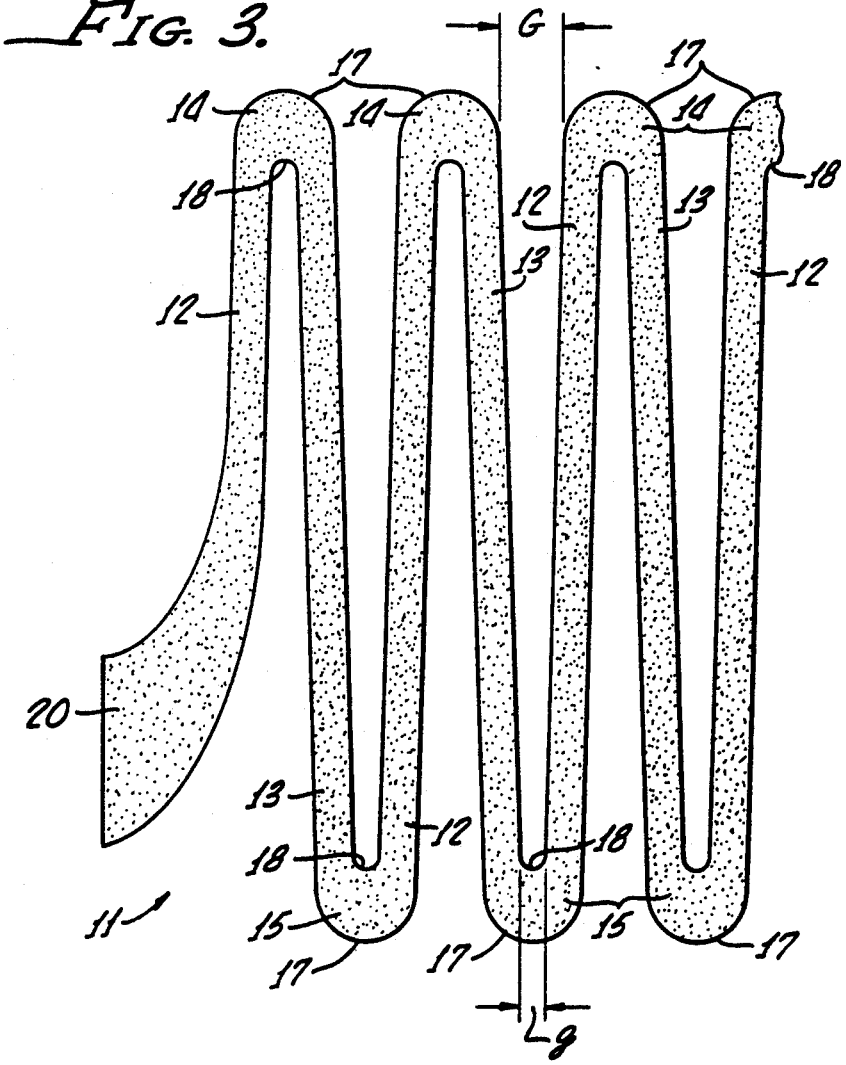

METHOD OF MANUFACTURING HIGH-VOLTAGE AND/OR HIGH-POWER THICK-FILM SCREEN-PRINTED CYLINDRICAL RESISTORS HAVING SMALL SIZES, LOW VOLTAGE COEFFICIENTS, AND LOW INDUCTANCE, AND RESISTOR THUS MANUFACTURED

BACKGROUND OF THE INVENTION

In high-voltage film resistors used for many types of applications, it is very important that there be a low voltage coefficient, it being understood that the voltage coefficient is the variation in resistance that occurs as applied voltage is increased or decreased (but not taking into account the resistance variation caused by self heating of the resistive film).

Another factor of major importance is the physical length of the resistor. The word "length" as here employed refers to the physical length of the substrate, as distinguished from the length of the resistive line on the substrate. It often occurs that the person designing a circuit board (or circuit assembly) can leave only a certain-length space for the resistor, and—furthermore—he or she normally wants the length of such space to be as short as possible. What is typically desired, therefore, is the highest possible voltage rating (voltage rating being the highest voltage that may be applied to the resistor) for a resistor that will fit in the shortest possible space.

To achieve the desired low voltage coefficient, the line of resistive film material is made long. Stated otherwise, the resistivity (ohms per square) of the film material is made lower while, at the same time, the line length is made greater. The longer line, with consequent reduced voltage gradient, results in the low voltage coefficient. However, the long line also results in small gaps between adjacent line sections. Accordingly, with a long line on a short substrate, and with high voltages being handled, there is the large risk that corona damage, resistor instability, and finally voltage breakdown (flashover), will occur.

Another important factor relative to many resistors is the inductance thereof. Often, the inductance must be made as low as possible, such as no greater than the inductance of a straight-line film the length of which is substantially the same as that of the substrate. There are, however, various applications where such minimized inductance (noninductance) is not demanded, where such factors as voltage coefficient, and substrate length, are more important.

Another major factor relative to many resistors, namely high-power resistors where maximum performance is to be achieved, is that migration of resistive film material can occur across gaps between apexes. Thus, for increased power and/or voltage ratings of power resistors, the tendency toward migration across the gaps must be reduced.

A crucial consideration is the cost of the resistor, and it is well known that the cost of capital equipment, and speed of production, are major factors regarding resistor cost. Screen-printed thick-film resistors have for decades proven to be relatively economical to produce. They are to be contrasted with (for example) resistors which require lasers or grinding machines for production in the desired patterns. It is much better to lay down (screen print) the desired film pattern initially, than to lay down a solid film and then—at major expense—laser-cut or grind it in order to form the pattern.

It is well known that cylindrical resistors, as distinguished from typical flat ones, are strong and relatively shock resistant, and have the capability of receiving long lines of film. Thus, for many uses, cylindrical film-type resistors are greatly desired.

SUMMARY OF THE INVENTION

In accordance with one aspect of the invention, a method is provided for manufacturing a cylindrical high-voltage resistor having a predetermined resistance value, a predetermined substrate length, and a predetermined maximum applied voltage (voltage rating). A V-serpentine pattern of thick-film resistive material is screen-printed onto a cylindrical substrate having the desired length, adjacent sections (legs or arms) of the V-serpentine pattern not being parallel but instead being at a small acute angle to each other. Such acute angle, and the substrate diameter, are so selected that the gaps between adjacent apexes at the open ends of the loops are sufficiently large to achieve greatly increased voltage handling capability in comparison to that of the gaps between adjacent sections of parallel-arm serpentine resistors having the same number of cycles (undulations). A determination is then made regarding whether the resistive line is sufficiently long to achieve a desired low voltage coefficient and consequent long-term stability. If not, the diameter of the cylindrical substrate is increased and a V-serpentine pattern having substantially the same gaps and substantially the same number of cycles is applied to the larger-diameter substrate. The resulting longer line of resistive material creates a lower voltage coefficient; the ability to handle the applied voltage remains the same. The stated steps are then repeated, with substrates of larger diameter, until the voltage coefficient is as desired.

As the resistive line is made longer, the resistivity of the resistive film material, and/or the width of the line, are varied so that the resistance value is the predetermined value indicated above.

In accordance with another aspect of the invention, the degree of angularity between adjacent line sections of the V-serpentine pattern is varied so as to achieve the desired degree of low inductance. With a relatively large diameter cylindrical substrate, the line sections can be close to parallel while still achieving the long line and consequent low voltage coefficient.

In accordance with another aspect of the invention, the V-serpentine pattern of thick-film resistive material, on a cylindrical substrate, is employed in power resistors to increase the ratings thereof without increasing the sizes thereof.

The invention further comprises resistors formed in accordance with the described method, and resistors having particular pattern and apex configurations.

BRIEF DESCRIPTION OF THE DRAWINGS

FIG. 1 is an isometric view illustrating a resistor constructed in accordance with the present method, and incorporating the invention of the present article;

FIG. 3 is a greatly enlarged portion of the developed view of FIG. 2, at the left end of the resistive film pattern as shown in FIGS. 2 and 3.

DETAILED DESCRIPTION OF THE PREFERRED EMBODIMENT

U.S. Pat. Nos. 3,858,147, 3,880,609 and 4,132,971 are hereby incorporated by reference herein, and describe the screen printing of thick-film resistive material onto cylindrical substrates, and describe the resulting resistors. It is to be understood that the method and resistor described herein are the same as are taught by said patents, except for the major differences set forth below.

All resistive films described and claimed in this application are deposited on elongate insulating cylinders that are, very preferably, formed of a ceramic such as (for example) aluminum oxide. One such cylinder is indicated at 10 in FIG. 1. In accordance with one aspect of the present method, a cylinder is selected that has diameter in the range of amount 1/10 inch to about ½ inch. The cylindrical substrate 10 has a length that varies, within limits, in accordance with the amount of space that the designer of a circuit board (or circuit assembly) on which the resistor is to be mounted has left for the resistor, it being emphasized that such space is, typically, small in comparison to the desired voltage and/or power handling capability of the resistor.

Figure 2:
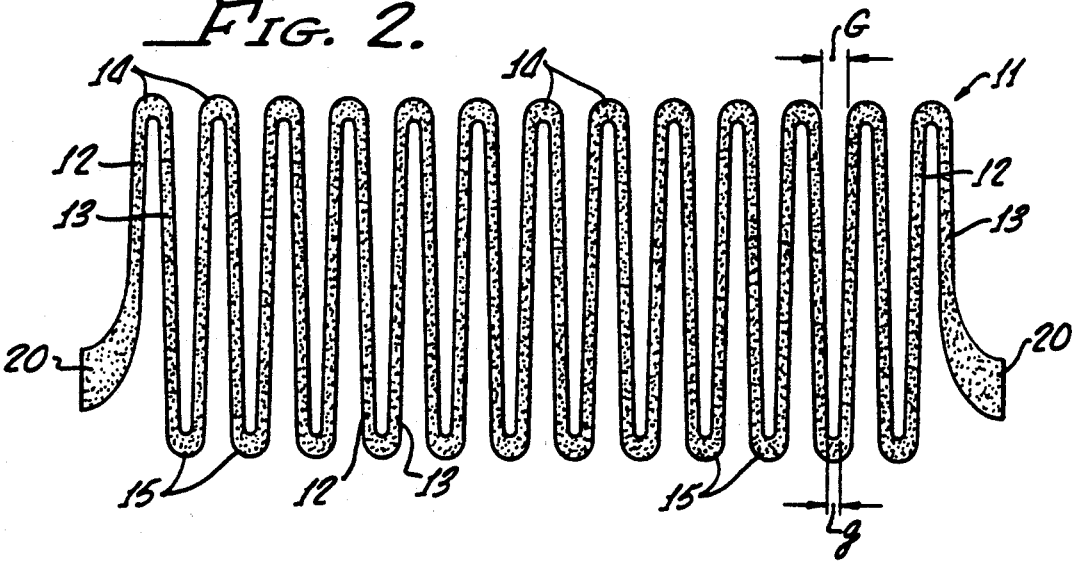
FIG. 2 is a developed view of the resistive film pattern on the resistor of FIG. 1.

In accordance with another aspect of the method, there is screen-printed onto substrate 10 a resistive film pattern 11 that is V-serpentine in configuration, as shown in FIGS. 1-3. "V-serpentine", as used in this specification and claims, denotes that adjacent sections (legs or arms) of the serpentine pattern are not parallel to each other but instead are at relatively small acute angles to each other. Those sections of resistive film that incline upwardly and to the right are given the reference numeral 12, while those that incline downwardly and to the right are given the reference numeral 13. All of the sections 12,13 are connected in series to each other, and collectively (together with the apexes) form the resistive "line".

Adjacent sections 12,13 connect to each other at apexes 14 that are at the top of pattern 11 as viewed in developed views 2 and 3, and at apexes 15 that are at the bottom of the pattern in such figures. The top apexes 14 and the bottom apexes 15 are disposed, respectively, along imaginary lines that are parallel to each other and to the axis of substrate 10. The two rows of apexes, namely the row of apexes 14 and the row of apexes 15, are separated from each other circumferentially of the substrate by an unprinted region 16 (FIG. 1) of the substrate 10, such region being herein called the "space" and extending for the full length of the substrate.

As best shown in FIG. 3, each apex 14,15 has a large dimension in a direction circumferentially of substrate 10, such dimension being large in comparison to the width of each line section 12,13 (the "width" being measured in a direction longitudinally of the substrate 10). The outer edge 17 of each apex is convex and substantially semicircular, and merges, at its ends, with those edges of adjacent line sections 12,13 that are relatively remote from each other. The inner edge 18 of each apex 14,15 is concave and also substantially semicircular, and merges with those edges of adjacent line sections 12,13 that are relatively adjacent each other.

Each two adjacent line sections 12,13 form what is called a "loop". Each loop has an open end and a closed end. Thus, referring to the second-from-right line section 12 in FIG. 3, it forms with the section 13 adjacent thereto, to the left, a loop having a small gap at the lower end thereof (the closed end of the loop) and a large gap at the upper end thereof (the open end of the loop). Such small gap is given the reference letter g (lower case g), while such large gap is given the reference letter G (upper case G). In like manner, there is an identical small gap at the closed end of each other loop (at both the top and bottom), and an identical large gap at each open end of each other loop (at both the top and bottom). The gaps are important to the present method and article, as set forth below.

At each end of the V-serpentine pattern 11 and respectively connected to line sections 12 and 13 as shown in FIGS. 2 and 3, there is a widened line portion 20 that bends outwardly toward the adjacent end of substrate 10 and extends substantially all of the way (preferably) to such adjacent substrate end. After firing of the pattern as described in the above-cited patents, highly conductive films 21 are screen-printed over the widened line portions 20 as shown in dashed lines in FIG. After another firing, cup-shaped cylindrical end caps 22,23, formed of metal, are press-fit over the ends of substrate 10 and thus over and in contact with the conductive films. When voltage is applied to axial leads 24,25 that are secured coaxially of end caps 22,23, respectively, the voltage is likewise applied to the films 21 and to widened line portions 20 and accordingly to the entire pattern 11.

The finished resistor, which incorporates not only the construction described above but that resulting from the method steps described above and below, is provided with an environmentally-protective coating or encapsulation. One type of such environmental coating is described in the above-cited U.S. Pat. No. 3,858,147 relative to FIG. 10 thereof. Another and very different type of coating is described in U.S. Pat. No. 4,866,411, which is hereby incorporated herein by reference.

The environmentally protective coatings described in the cited patents increase the dielectric strengths of the various gaps G between adjacent apexes 14 and between adjacent apexes 15. Furthermore, the entire resistors are frequently potted in potting compounds that increase the dielectric strengths between end caps 22 and 23, so as to increase the voltage ratings of the resistors vis-a-vis end-to-end coronas and discharges. When the end-to-end voltage rating of a particular resistor is thus increased, the resistance to breakdown (flashover) between adjacent apexes 14 or adjacent apexes 15 becomes more and more important.

In accordance with one aspect of the present invention, the resistance to breakdown between adjacent apexes 14, and adjacent apexes 15, is greatly increased while, at the same time, the voltage coefficient of the resistive line is made low. Furthermore, in accordance with another aspect of the invention, the inductance of the resistor is maintained quite close to that of a standard serpentine resistor having parallel line sections (legs or arms), the latter type of resistor not having the presently-described high resistance to breakdown, as set forth below.

The resistor described above relative to FIGS. 1, 2 and 3 has a predetermined resistance value, a predetermined substrate length, and a predetermined maximum applied voltage (voltage rating). The predetermined resistance value depends upon the length and width of the line of resistive film, and upon the resistivity of the particular thick-film resistive material employed. Stated in another manner, the resistance of the resistive line depends on the number of squares multiplied by the resistivity of the film material, in ohms per square. As above indicated, the predetermined substrate length is typically determined, within limits, by the designer of the circuit board (or circuit assembly) and is typically short in comparison to the desired voltage rating of the resistor. Such voltage rating is also predetermined, being that value determined by the circuit designer for the particular application.

The V-serpentine pattern 11 has the major advantage relative to cost, that it may be deposited in a relatively small number of seconds—without need for any significant laser cutting or grinding steps. Yet, such V-serpentine pattern has a greatly increased voltage (or power) rating in comparison to what may be termed a "standard serpentine" resistor the sections (arms or legs) of which are parallel to each other. The words "standard serpentine" are used because such parallel-arm cylindrical resistor has been sold in volume for decades.

If a standard serpentine (parallel section) resistor were provided having substantially the same substrate size, line width, resistivity in ohms per square, line length, amplitude of undulation, number of cycles, etc., such standard serpentine resistor would have a voltage rating greatly lower than that of the resistor of FIGS. 1–3. The reasons for such lower rating are shown by a table provided toward the end of this specification. After the dielectric strength between end caps 22 and 23 has been built up by excellent potting and other means, it is (as above indicated) the size of the gaps G at the open ends of the loops, on each side of space 16, that in very large part determines the voltage rating.

It is greatly preferred that all of the gaps G have the same size so as to distribute, to a maximum extent possible, the resistance to voltage breakdown. It is pointed out that the gaps G on one side of space 16 are considered separately from the gaps G on the other side thereof. If, for example, the gaps G between apexes 15 on one side of space 16 were less large than the gaps G between apexes 14 on the other side of such space, the size of the first-mentioned gaps G would limit the voltage rating of the resistor. Such form is not preferred.

The reason the sizes of open-end gaps G are determinative—and increase the voltage rating in comparison to that resulting from the gaps between parallel sections of standard serpentine resistors—is that the maximum voltage drop is present across each open-end gap G. Referring, for example, to the second-from-left and third-from-left apexes 14 shown in FIG. 3, the voltage across gap G is the same as the voltage drop through the entire adjacent section 13, through the bottom apex 15, and through the entire other adjacent section 12. The voltage drop across the bottom gap g in FIG. 3 is, on the other hand, relatively insignificant in that it is equal to only the voltage drop across the associated apex 15. Between the bottom and top gaps g and G shown in FIG. 3, the sizes of the gaps progressively increase as G is approached, this being in accord with the fact that the voltage drops, horizontally between sections 13 and 12, progressively increase as G is approached.

Referring to FIG. 2, there are 12 gaps G between apexes 14 at the top of pattern 11. With linear voltage drops along the length of the line, as is the preferred form, the voltage drop across each gap G between adjacent apexes 14 is approximately 1/12 the applied voltage. For example, if the applied voltage is 10,000 volts, the drop across each gap G between adjacent apexes 14 is about 800 volts (there being some voltage drop through the line sections leading from the outermost apexes 14 to wide line portions 20). Such 800 volts per gap G is across a space (in the case of each pair of adjacent apexes 14) greatly wider than the space between adjacent sections of a standard serpentine resistor having the same number of undulations, etc., as noted above and below.

The resistor of FIGS. 1–3 may not, however, have a voltage coefficient as low as desired by the circuit board (or circuit assembly) designer, the result being that the resistance of the resistor changes with applied voltage to an extent greater than what is desired by the designer. In addition, the resistor of FIGS. 1–3 may have an inductance that is less low than that desired by the designer. Both of these conditions are improved by performance of the method step next described.

Figure 4:
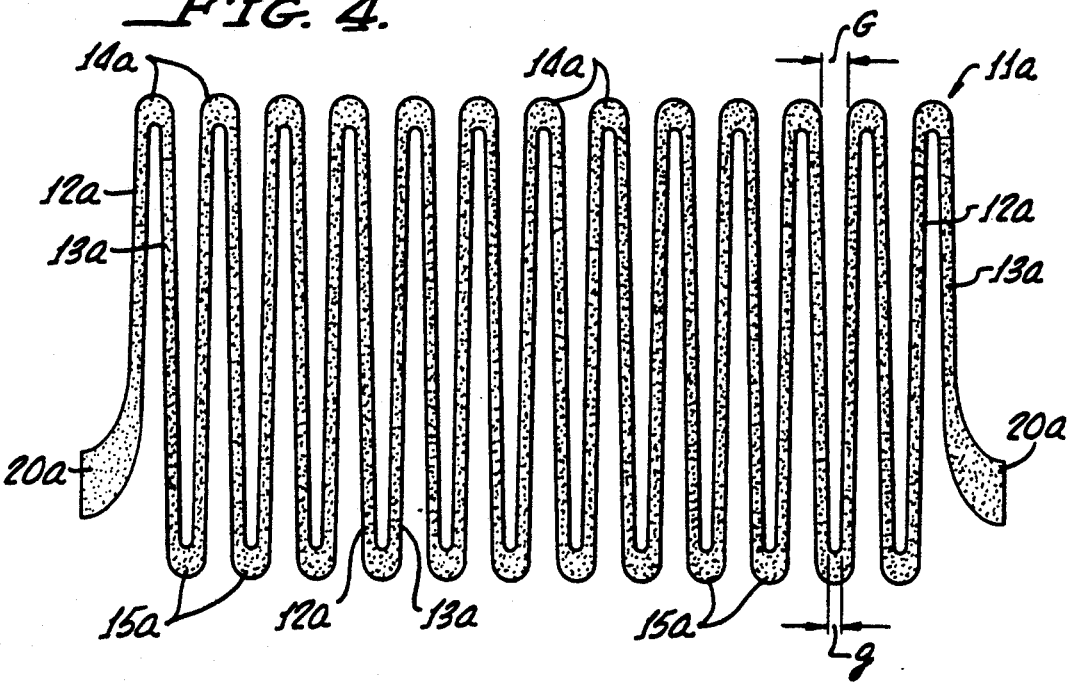
FIG. 4 is a developed view of the resistive film pattern on a cylindrical substrate the diameter of which is substantially larger than is that of the cylindrical substrate of FIG. 1 (and FIGS. 2 and 3).

Referring next to FIG. 4, the best mode of the method comprises depositing on a cylindrical substrate the diameter of which is substantially larger than that of substrate 10 a V-serpentine pattern 11*a* that is identical to pattern 11 except that the amplitude of the undulations (height of the pattern) is increased. The diameter of the cylindrical substrate on which pattern 11 is deposited is increased, and is such that the space (not shown, and corresponding to space 16 in FIG. 1) has substantially the same dimension circumferentially of the substrate as does the space 16 of FIG. 1. There are provided end caps, overprint layers of conductive film which cover widened portions 20*a*, etc., corresponding to FIG. 1. The end caps have such diameters as to be (and are) press-fit over the larger-diameter substrate on which pattern 11*a* is deposited.

The length of the resistive line of the pattern 11*a* of FIG. 4 is greatly longer than is the length of the line in the pattern 11 of FIG. 2, which means that the voltage coefficient of pattern 11*a* is distinctly lower than is that of pattern 11. The length of the cylindrical substrate in the best mode of the method is the same relative to the pattern 11*a* of FIG. 4 as it is relative to the pattern 11 of FIG. 2. The resistance value is, in accordance with the method, caused to be the same relative to pattern 11*a* as it is relative to pattern 11, this being accomplished by reducing the resistivity of the film material in accordance with the increased length of line or, alternatively, by increasing the width of the resistive line to compensate for the increased length. The amplitude being greater, it is to be understood that if the resistivity of the film is not changed then the width of the line is increased so that there will be the same number of squares in the pattern of FIG. 4 as in the pattern of FIGS. 1–3. It is emphasized, however, that increasing the width of the line reduces the size of gap G, so changing the resistivity of the thick-film material is greatly preferred.

The maximum applied voltage, namely the voltage rating, is the same relative to the resistor of FIG. 4 as relative to the resistor of FIGS. 1–3. The size of each gap G and each gap g is the same vis-a-vis the FIG. 4 resistor as is the case relative to the FIGS. 1–3 resistor, provided line width is not changed. Accordingly, the voltage rating is the same relative to such FIG. 4 resistor as relative to the FIGS. 1–3 resistor. The voltage drop across each gap G is the same because the voltage gradient is reduced in pattern 11*a* as compared to that in pattern 11.

As above stated, the method further comprises maintaining the diameters of the cylindrical substrates in the range of about 1/10 inch to about ½ inch. For example, if the diameter of substrate 10 of the resistor of FIGS. 1-3 is about ⅓ inch, then that of the substrate of the resistor of FIG. 4 may be about ½ inch.

In performing the method, it is preferred to start with patterns for the smaller diameter substrates—within the specified range—and then, if necessary, increase the pattern height so as to achieve the desired voltage coefficient. This is because (except for extremely small diameter resistors) the smaller diameter resistors cost less to produce than do the larger diameter resistors. It is pointed out, however, that the method may also (less preferably) be performed in the reverse manner. Thus, for example, the first pattern may be for a relatively large diameter substrate within the specified range, following which a determination is made regarding whether or not the voltage coefficient is substantially lower than that required by the designer. If so, the pattern height is reduced in order to reduce resistor costs while increasing the voltage coefficient—so long as the voltage coefficient remains equal to or lower than what is required by the designer.

In accordance with another aspect of the invention, the method comprises altering the angularity between adjacent sections of the V-serpentine pattern in order to produce an inductance value substantially equal to the value desired by the circuit board (or circuit assembly) designer. In applications where the designer does not require the maximum voltage rating, but does desire a relatively low inductance value, the angle between adjacent sections 12 and 13 is reduced somewhat; the voltage rating is thereby reduced somewhat and the inductance is also reduced. The voltage coefficient remains the same.

Let it be assumed, for example, that a designer requires a cylindrical resistor having an improved noninductive characteristic in comparison to that provided by the V-serpentine pattern that produces the greatest voltage-handling improvement (namely, by having the greatest gaps G between adjacent sections). The present aspect of the invention then comprises producing a cylindrical resistor having a V-serpentine pattern and which balances the noninductive performance against the voltage handling performance, by causing the adjacent line sections 12,13 to be at a somewhat smaller angle to each other. Thus, on an application-by-application basis, the noninductive characteristic is balanced against the improved voltage handling characteristic, the latter characteristic resulting from employing the V-serpentine pattern instead of the standard serpentine pattern described above.

It is emphasized that the pattern 11*a* shown in FIG. 4 has a lower inductance than that of the pattern 11 shown in FIG. 2. This is because the gaps G in FIGS. 4 and 2 are the same, and the gaps g are also the same, yet the amplitude of the V-serpentine pattern is greater in FIG. 4 than in FIG. 2. The gaps being equal in the two figures, and the amplitude being greater in FIG. 4, it follows that the angularity between the adjacent sections of the resistive line is smaller in FIG. 4 than in FIG. 2, causing the pattern 11*a* to have a lower inductance than that of pattern 11.

The width of the resistive line employed in the present method and article, that is to say the width of each section 12,13, or 12*a*,13*a*, is in the range of about 10 mils to about 40 mils, and is preferably in the range of about 15 mils to about 30 mils. The preferred width for the great majority of applications is about 20 mils. Such widths are preferred because of ease of screen-print deposition of reliable lines, and because of performance.

The minimum size of the gap g is 5 mils. To minimize the size of gap g, and thus achieve the stated 5 mil minimum, a resistance material may be employed that has such rheology and flow characteristics that during firing the gap g does not disappear. Thick-film resistive materials having such rheology and flow characteristics include DuPont Series 17, produced by DuPont Corporation of Wilmington, Delaware. Another is Ferro 850 Series, by Ferro Corporation of Santa Barbara, Calif.

The maximum size of gap G is 60 mils. The minimum size of each gap G is always substantially larger than is that of each gap g.

The ratio of the width of gaps G to the width of the angularly-related resistive line sections is in the range of about 1.2 (gap G width) to 1 (line width), to about 3 (gap G width) to 1 (line width). These ratios improve greatly the compactness of the resistor, and permit very long lines to be employed.

It is to be understood that the described method steps relative to changing the diameter of the substrate, etc., need not be physically performed relative to actual existing cylinders, films, etc., but instead can be performed by (for example) computer simulation. Thus, a serpentine pattern is plotted on a computer, for example by employing the cursor of an "Apple" computer. After the pattern (for example, that of FIG. 2) is generated, the characteristics of the pattern are determined vis-a-vis resistance value, voltage coefficient, inductance, etc. Thereafter, the height of the pattern is increased by operation of the computer (for example, to that of FIG. 4). The characteristics are again determined and the steps repeated as many times as necessary. Then, actual physical cylindrical V-serpentine resistors are made, using the pattern finally generated. The resistors are tested and, if necessary, are modified in accordance with the principles specified herein.

The following table provides specific examples of V-serpentine cylindrical resistors constructed in accordance with the present method. Furthermore, the table compares certain of such resistors with certain standard serpentine resistors. The table is made with the preferred 20 mil width of resistive line, namely, the width of sections 12,13,12*a* and 13*a*, but it is to be understood that other line widths may be employed as described above. The height (amplitude) of the serpentine pattern is in each case 0.720 of an inch. The length of the substrate is, in each case, 1.250 inch. The diameter of the substrate is 0.250 of an inch in each instance. As set forth above, the "standard serpentine" is the widely used cylindrical resistor having parallel sections (arms or legs). The "V-serpentine" is the present resistor as made by the present method.

| | Comment | Line width | Gap width at open end of loop | Gap width at closed end of loop | Width of one complete serpentine cycle | Relative Voltage Handling Capability Gap - as a % of width of one complete cycle | | Relative Line Length. Example (Multiple Complete Cycles) 0.960 inch wide (See Note) |
|---|---|---|---|---|---|---|---|---|
| 1. | Standard Serpentine in which Gap width equals line width | 0.020 inch | 0.020 inch | 0.020 inch | 0.080 inch | 25% | (20/80) | 12 Complete Cycles #1 reference |
| 2. | Standard Serpentine in which Gap width is 2 times line width | 0.020 inch | 0.040 inch | 0.040 inch | 0.120 inch | 33.3% | (40/120) | 8 cycles (66% of the line length of #1) |
| 3. | Standard Serpentine in which Gap width is 3 times line width | 0.020 inch | 0.060 inch | 0.060 inch | 0.160 inch | 37.5% | (60/160) | 6 cycles (50% of the line length of #1) |
| 4. | V-serpentine in which gap g is 10 mils | 0.020 inch | 0.030 inch | 0.010 inch | 0.080 inch | 37.5% | (30/80) | 12 cycles (100% of the line length of #1) |
| 5. | V-serpentine in which gap g is 5 mils | 0.020 inch | 0.035 inch | 0.005 inch | 0.080 inch | 43.75% | (35/80) | 12 cycles (100% of the line length of #1) |

Note:
The widths of the cycles are measured longitudinally of the substrate; thus, the 0.960 figure is the length of the pattern (not counting widened end portions of the pattern, such as are shown at 20 in the present drawings of the V-serpentine resistor).

The voltage coefficient is determined, with reference to any particular pattern shown or referred to herein, by use of empirically-determined data.

The present V-serpentine thick-film screen-printed pattern, as described above, on a cylindrical substrate also produces major advantages relative to power resistors where maximum power-and-voltage handling capability is of major importance. Under conditions where the power is DC, and where somewhat over maximum rated voltage and/or somewhat over maximum rated power occur simultaneously, the resulting high surface temperature causes migration of resistance material across the gaps between the apexes of standard serpentine resistors. This is a limitation preventing higher ratings of the resistors. With the present large gaps G but with the same-substrate and same-size line of resistance material, power and/or voltage ratings may be increased substantially without causing this migration effect. In summary, therefor, there is achieved the important result of having very high-performance cylindrical thick-film screen-printed resistors with higher ratings yet which are not larger in size, which resistors are relatively economical to produce and are extremely reliable.

The foregoing detailed description is to be clearly understood as given by way of illustration and example only, the spirit and scope of this invention being limited solely by the appended claims.

What is claimed is:

1. A method of creating a compact high-voltage thick-film screen-printed elongate cylindrical resistor without need for any laser cutting or grinding, and with a high voltage rating and a low voltage coefficient, said method comprising:

(a) determining the resistance value, the substrate length, the voltage coefficient, and the voltage rating that a compact high-voltage thick-film screen-printed elongate cylindrical resistor is to have, (b) forming a V-serpentine pattern, for a thick-film resistive material, which pattern is adapted to fit on an insulating cylindrical substrate having said length and in the substrate-diameter range of about 1/10 inch to about ½ inch, said V-serpentine pattern having a line width, having a line length, and having a height, said V-serpentine pattern having adjacent sections that are not parallel to each other but instead are at a small acute angle to each other, said V-serpentine pattern having gaps at the open ends of the loops of said pattern that are substantially wider than the gaps at the closed ends of said loops, said V-serpentine pattern having a sufficient number of undulations, and having gaps of sufficient size at the open ends of the loops, to achieve said voltage rating, the resistivity of said resistive material, and said line width of the sections of said pattern, and said line length of said pattern, being such as to achieve said resistance value, (c) determining whether or not said pattern of said resistive material has a voltage coefficient that meets said voltage coefficient, (d) substantially changing said height of said pattern to achieve a voltage coefficient substantially corresponding to said voltage coefficient, and also altering said thick-film resistive material to cause said thick-film resistive material to have a different resistivity, said different resistivity being such that said same resistance value is achieved, (e) screen-printing said altered thick-film resistive material in said last-specified pattern onto a cylindrical insulating substrate having said length and in said diameter range, said height of said pattern and said diameter of said substrate being so related that there is a substantial space, circumferentially of said substrate, between rows of apex portions of said pattern, and (f) providing end terminations for said resistive pattern.

2. The invention as claimed in claim 1, in which said method further comprises initially forming said pattern for a relatively small diameter substrate within said range, and effecting said changing of the height of said pattern by increasing the height of said pattern and thereby lowering the voltage coefficient.

3. The invention as claimed in claim 2, in which said changing of the height of said pattern is done without substantially changing the length of said pattern, or the number of undulations, or the sizes of the gaps at the open ends of the loops of said pattern.

4. The invention as claimed in claim 1, in which said changing of the height of said pattern is done without substantially changing the length of said pattern, or the number of undulations, or the sizes of the gaps at the open ends of the loops of said pattern.

5. The invention as claimed in claim 1, in which said method further comprises causing the maximum size of said gaps between apexes of said pattern at the open ends of the loops thereof to be 60 mils.

6. The invention as claimed in claim 5, in which said method further comprises causing the line width of said pattern, at angularly-related sections thereof, to be in the range of 10 mils to 40 mils.

7. The invention as claimed in claim 1, in which said method further comprises causing the ratio of the width of said gaps between apexes of said pattern at the open ends of said loops, to the line width of said pattern at angularly-related sections thereof, to be in the range of about 1.2 to 1, to about 3 to 1.

8. The invention as claimed in claim 7, in which said method further comprises causing the line width of said pattern, at angularly-related sections thereof, to be in the range of 15 mils to 30 mils.

9. The invention as claimed in claim 1, in which said method further comprises causing the maximum size of said gaps between apexes of said pattern at the open ends of the loops thereof to be 60 mils, in which said method further comprises causing the line width of said pattern, at angularly-related sections thereof, to be in the range of about 15 mils to about 30 mils, and in which said method further comprises causing the ratio of the width of said gaps between apexes of said pattern at the open ends of said loops, to the line width of said pattern at angularly-related sections thereof, to be in the range of about 1.2 to 1, to about 3 to 1.

10. The invention as claimed in claim 5, in which said method further comprises causing the line width of said pattern, at angularly-related sections thereof, to be about 20 mils.

11. The invention as claimed in claim 1, in which said method further comprises causing the line width of said pattern, at angularly-related sections thereof, to be about 20 mils.

12. The invention as claimed in claim 1, in which said method further comprises providing said end terminations in the form of cup-shaped end caps that are press-fit over the ends of said substrate, and are caused to electrically contact the ends of said pattern.

13. A resistor constructed in accordance with the method set forth in claim 1.

14. A thick-film screen-printed elongate cylindrical resistor, which comprises:

(a) an elongate cylindrical substrate having a diameter in the range of about 1/10 inch to about ½ inch, (b) a V-serpentine screen-printed pattern of thick-film resistive material adherently applied onto said substrate in such orientation that there are two rows of apexes of said pattern, said two rows of apexes being generally along lines that are generally parallel to each other and to the axis of said substrate, said apexes in each of said two rows being separated from each other by gaps, said rows being spaced apart circumferentially of said pattern, to thereby form a space between said rows, said pattern having line sections of adjacent lines that are not parallel to each other but instead are at small acute angles to each other, said pattern having line sections of adjacent lines that are not parallel to each other but instead are at small acute angles to each other, said apexes of said V-serpentine pattern each having an outer edge, closest to said space between said rows, that is convex and rounded, said gaps between said apexes at the open ends of the V-serpentine loops, and determined in a direction longitudinal to said substrate, being sufficiently large to cause said resistor to have a high voltage and/or power rating, said gaps at said open ends of said loops being substantially larger than are the gaps at the closed ends of said loops, said pattern having end portions that extend to the vicinities of the ends of said substrate, (c) cup-shaped metal end caps press-fit on the ends of said substrate and electrically connected, respectively, to said end portions, (d) leads connected to said end caps, and (f) an environmentally-protective insulating coating provided over said pattern.

15. The invention as claimed in claim 14, in which the maximum size of said gaps at said open ends of the loops of said V-serpentine pattern is 60 mils.

16. The invention as claimed in claim 15, in which said angularly-related line sections of said pattern have line widths in the range of 10 mils to 40 mils.

17. The invention as claimed in claim 16, in which said range is 15 mils to 30 mils.

18. The invention as claimed in claim 14, in which each of said apexes has a dimension, circumferentially of said substrate, that is substantially larger than the widths of said line sections.

19. The invention as claimed in claim 14 in which the ratio of the width of said gaps between apexes of said pattern at the open ends of said loops, to the line width of said pattern at angularly related sections thereof, is in the range of about 1.2 to 1, to about 3 to 1.

20. A thick-film screen-p elongate cylindrical resistor, which comprises:

(a) an elongate cylindrical substrate having a diameter in the range of about 1/10 inch to about ½ inch, (b) a V-serpentine screen-printed pattern of thick-film resistive material adherently applied onto said substrate in such orientation that there are two rows of apexes of said pattern and these two rows are generally along lines that are generally parallel to each other and to the axis of said substrate, there being gaps between said apexes in each of said rows, said rows being spaced apart circumferentially of said pattern, to thereby form a space between said rows, said pattern having line sections of adjacent lines that are not parallel to each other but instead are at small acute angles to each other, said gaps between said apexes in each of said rows, at the open ends of the V-serpentine loops, and determined in a direction longitudinal to said substrate, being sufficiently large to cause said resistor to have a high voltage and/or power rating, said gaps at said open ends of said loops being substantially larger than are the gaps at the closed ends of said loops, the ratio of the width of said gaps between apexes of said pattern at said open ends of said loops, to the line width of said pattern at angularly-related sections thereof, being in the range of 1.2 to 1, to 3 to 1, said pattern having end portions that extend to the vicinities of the ends of said substrate, (c) cup-shaped metal end caps press-fit on the ends of said substrate and electrically connected, respectively, to said end portions, (d) leads connected to said end caps, and (e) as environmentally-protective insulating coating provided over said pattern.

21. A method of manufacturing a cylindrical thick-film screen-printed resistor having predetermined desired characteristics relative to both voltage/power rating and inductance, which method comprises:

(a) providing an elongate cylindrical insulating substrate, (b) generating a V-serpentine pattern for screen-printing of thick-film material onto said substrate, said pattern having adjacent line sections that are disposed at small angles relative to each other, (c) varying said small angles of said pattern in order to balance the inductance of a screen-printed thick-film resistive film having the shape of said pattern against the voltage and/or power-handling capability of said resistive film, to thus achieve a predetermined desired inductance and a predetermined desired voltage/power rating, (d) adhering to said substrate a screen-printed thick-film resistive line having said thus-determined pattern, to thereby achieve said resistive film having said predetermined desired inductance and said predetermined desired voltage/power rating an d (e) providing termination means connected to the ends of said line on said substrate.

* * * * *

UNITED STATES PATENT AND TRADEMARK OFFICE

CERTIFICATE OF CORRECTION

PATENT NO. : 5,231,372

DATED : July 27, 1993

INVENTOR(S) : Richard E. Caddock, Jr.

It is certified that error appears in the above-identified patent and that said Letters Patent is hereby corrected as shown below:

Claim 14 (column 12, lines 3-5), delete "said pattern having line sections of adjacent lines that are not parallel to each other but instead are at small acute angles to each other,".

Claim 20 (column 12, line 42), delete "screen-p" and substitute therefor ---screen-printed---.

Claim 21 (column 14, line 16), delete "rating an d" and substitute therefor ---rating, and---.

Signed and Sealed this

Twenty-sixth Day of April, 1994

Bruce Lehman

*Attest:*

BRUCE LEHMAN

*Attesting Officer*

*Commissioner of Patents and Trademarks*